United States Patent [19]

Bodine

[11] Patent Number: 4,693,326

[45] Date of Patent: Sep. 15, 1987

[54] CYCLOIDAL EARTH CUTTING SYSTEM WITH ROCKER-TYPE NUTATING ACTION

[76] Inventor: Albert G. Bodine, 7877 Woodley Ave., Van Nuys, Calif. 91406

[21] Appl. No.: 736,079

[22] Filed: May 20, 1985

Related U.S. Application Data

[63] Continuation-in-part of Ser. No. 505,954, Jun. 20, 1983, which is a continuation-in-part of Ser. No. 262,650, May 11, 1981, Pat. No. 4,403,665.

[51] Int. Cl.[4] ..... F21B 7/24

[52] U.S. Cl. ..... 175/55; 175/56; 175/107; 74/61

[58] Field of Search ..... 175/55, 56, 106, 107, 175/343, 354, 371; 173/49; 74/61

[56] References Cited

U.S. PATENT DOCUMENTS

| | | | |
|---|---|---|---|
| 2,950,901 | 8/1960 | Mathewson, Jr. | 74/61 X |
| 4,261,425 | 4/1981 | Bodine | 175/55 X |
| 4,271,915 | 6/1981 | Bodine | 175/105 X |

FOREIGN PATENT DOCUMENTS

| | | | |
|---|---|---|---|
| 1122809 | 11/1984 | U.S.S.R. | 175/55 |

*Primary Examiner*—Stephen J. Novosad

*Assistant Examiner*—David J. Bagnell

*Attorney, Agent, or Firm*—Edward A. Sokolski

[57] ABSTRACT

Sonic energy in a cycloidal or quadrature action pattern is generated in a drill stem by means of a sonic oscillator employing an eccentrically weighted rotor. The stem is coupled to the drill bit by means of a rocker-type joint thereby forming a pivot fulcrum for limited motion of the bit both vertically and laterally in a nutating path. The rocker action develops a powerful longitudinal vibratory force at the cutter teeth for more effective drilling action. The rocker joint in one embodiment is formed by horizontal and vertical shoulders formed in the top end of the bit assembly by virtue of an undercut portion formed in such assembly in which the lower edge of the drilling jacket is received with the bottom edge of such jacket opposite the horizontal shoulder and the inner surfaces of the jacket opposite the vertical shoulder. In another embodiment, suitable for use where precise control of drilling direction is required, limited rocking motion is provided by means of a special fulcrum guidance structure. In still a third embodiment adapted for use as a rock splitter, incorporated into a rock stripping wheeled loader, the rocking motion is constrained by means of a centering spring which may be of an elastomeric material.

12 Claims, 8 Drawing Figures

CYCLOIDAL EARTH CUTTING SYSTEM WITH ROCKER-TYPE NUTATING ACTION

This application is a continuation in part of my application Ser. No. 505,954, filed June 20, 1983 which in turn, is a continuation in part of my application Ser. No. 262,650, filed May 11, 1981, now U.S. Pat. No. 4,403,665.

This invention relates to earth cutting systems and more particularly to such a system employing sonic cycloidal drilling action in conjunction with a rocker-type coupling between the drill stem and the drill bit.

In my U.S. Pat. No. 4,271,915, and my application Ser. No. 505,954 of which the present application is a continuation in part, sonic earth cutting systems as incorporated into drilling systems are described in which the sonic energy is generated so as to cause cycloidal precession or nutating action of the drill bit around the bore hole. The system of the present invention is an improvement over these prior art cycloidal drilling systems in that it provides substantially greater longitudinal vibratory force at the bit. At the same time, in view of the rocker-type coupling between the vibrating drill stem and the drill bit, resonant vibration of the drill stem tends to suffer less from damping by the work load. Further, with the system of the present invention, a better impedance match to high impedance rock formations is attained.

In achieving the aforementioned improved end results, the system of the present invention employs a rocker type connection between the cycloidally vibrated drill stem and the drill bit. This rocker type connection forms the fulcrum of a lever arm for the bit, which provides nutating action with a strong vertical component of vibratory driving force, along with limited lateral motion of the bit. In one embodiment of the invention, this rocker type joint and lever are implemented by means of an undercut portion on the top end of the drill bit assembly, this portion having horizontal and vertical shoulders. The end portion of the drill jacket which surrounds the drill stem is fitted into the groove in a loose coupling therewith, the inner surfaces of the jacket being opposite the vertical shoulder of the undercut portion of the drill bit assembly to limit lateral relative motion of the drill bit while the bottom edge of the jacket is opposite the horizontal shoulder of the groove providing an interface for transfer of vertical components of vibratory energy to the bit as well as providing a fulcrum for the bit in the transfer of this energy so that the bit is made to rock and nutate against the bore hole bottom as a result of the cycloidal vibration of the drill stem. The present system is also described as incorporated into a rock splitter.

It is therefore an object of this invention to improve the drilling action of an earth cutting system.

It is a further object of this invention to provide an improved sonic drill having a nutating sonic drilling action with a high vertical force component.

It is still another object of this invention to lessen the damping effect of a high impedance load on a resonantly vibrating earth cutting system.

Other objects of this invention will become apparent as the description proceeds in connection with the accompanying drawings of which:

Figure 1:
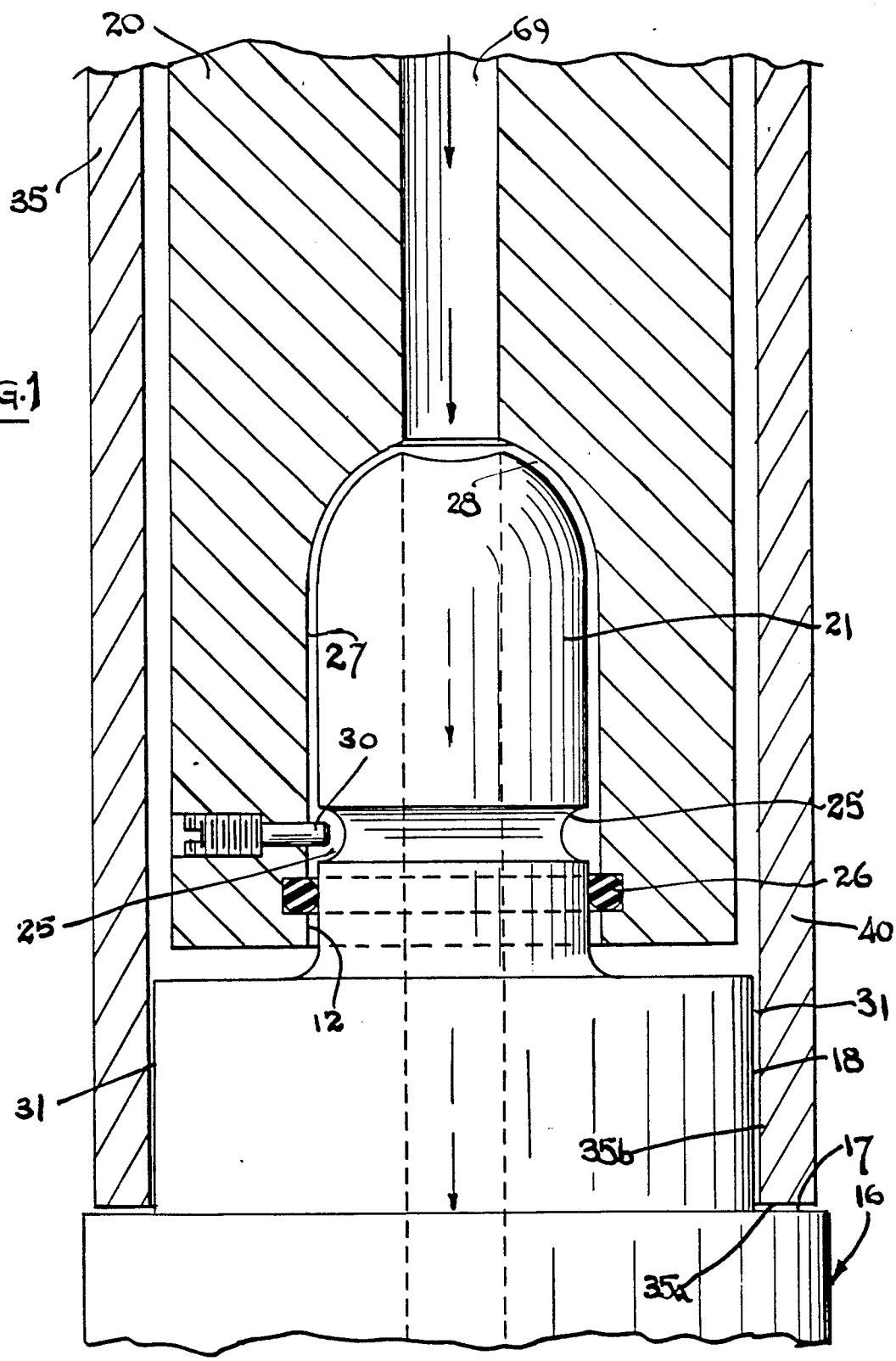
FIG. 1 is an elevational view in cross section illustrating a first embodiment of the invention.

Referring to FIG. 1, the top of drill bit assembly 16 has a bell-shaped extension portion 21 which is fitted into a mating, socket 27 formed in the bottom end of drill stem 20. The bit is retained to the cavity by means of retainer pin 30 threadably engaging drill stem 20 and protruding into annular groove 25 formed in the extension portion 21 of the bit assembly. An "O"-ring 26 is provided to prevent drill cuttings and other extraneous matter from entering socket 27. An undercut portion 31 is formed around the outer wall of drill bit assembly 16. The end of drilling jacket 35 is loosely fitted around undercut portion 31 such that the bottom edge **35*a* of the jacket is opposite horizontal shoulder 17 of the assembly and the bottom inner wall portion 35*b* of the jacket is positioned opposite vertical shoulder 18 of the undercut portion. Drill stem 20 which forms an elastic bar member is sonically driven in a cycloidal or quadrature mode of vibration by means of an orbiting mass oscillator. The structure and operation of such an oscillator is described in my U.S. Pat. No. 4,271,915 and my co-pending application Ser. No. 505,954 of which the present application is a continuation in part, and the disclosures of this patent and application are herein incorporated by reference to provide a complete disclosure of this structure. In response to this cycloidal vibration, the lower end of stem 20, which is an elastic bar member, cycloidally vibrates with a net circular motion having an orbit with a radius determined by the elasticity of drill stem 20. The top end of bell shaped member 21 is driven around in a circular orbit by the elastic vibration of the drill stem. Lateral motion of drill bit assembly 16 is limited by virtue of the interface between vertical shoulder 18 of undercut portion 31 and inner wall 35*b* of jacket 35. The clearance between drill stem 20 and drill bit 16 is generally greater at 12 and 27 than at space 28 so that the vibrational energy will be principally transferred to bell shaped member 21 at the top end thereof. The coupling of energy at the top end of the bell shaped member provides a good leverage distance for the action of the vibratory energy at the cutters of the bit assembly. The small clearance gap 28 provided between drill stem 20 and member 21 affords rectifier action for the sonic energy, providing sharp unidirectional shock components to aid in the cutting action of the bit cutter teeth. It is to be noted that "O"-ring 26 not only prevents cuttings from reaching the bearing surfaces, but also seals off mud flow at this point, the mud flow path being confined to channel 69**.

In response to the cyclic vibratory energy, the bit assembly 16 nutates with horizontal shoulder 17 of the bit assembly rolling around the bottom edge **35*a* of the jacket. Inner wall 35*b* of the jacket limits lateral motion of the drill bit by virtue of its interface with vertical shoulder 18 of the drill bit assembly. The bottom edge 35***a* of jacket 35 is biased by virtue of its weight against horizontal shoulder 17 of the drill bit assembly, and thus a rolling pivotal fulcrum is provided at this point for the lever arm formed by the bit assembly between this fulcrum and the cutter heads. With the cycloidal rotation of the bit assembly about the fulcrum formed at the interface between shoulder 17 and bottom edge 35*a* of the jacket, the cutter heads of the bit are nutated about the bore hole so as to shift the load concentration in a continual manner as the orbiting motion occurs. This is quite advantageous in that the load on the bit is constantly being shifted as against typical drilling operations where the bit is driven so as to be constantly loaded in a uniform manner against the earthen formation.

Figure 2:
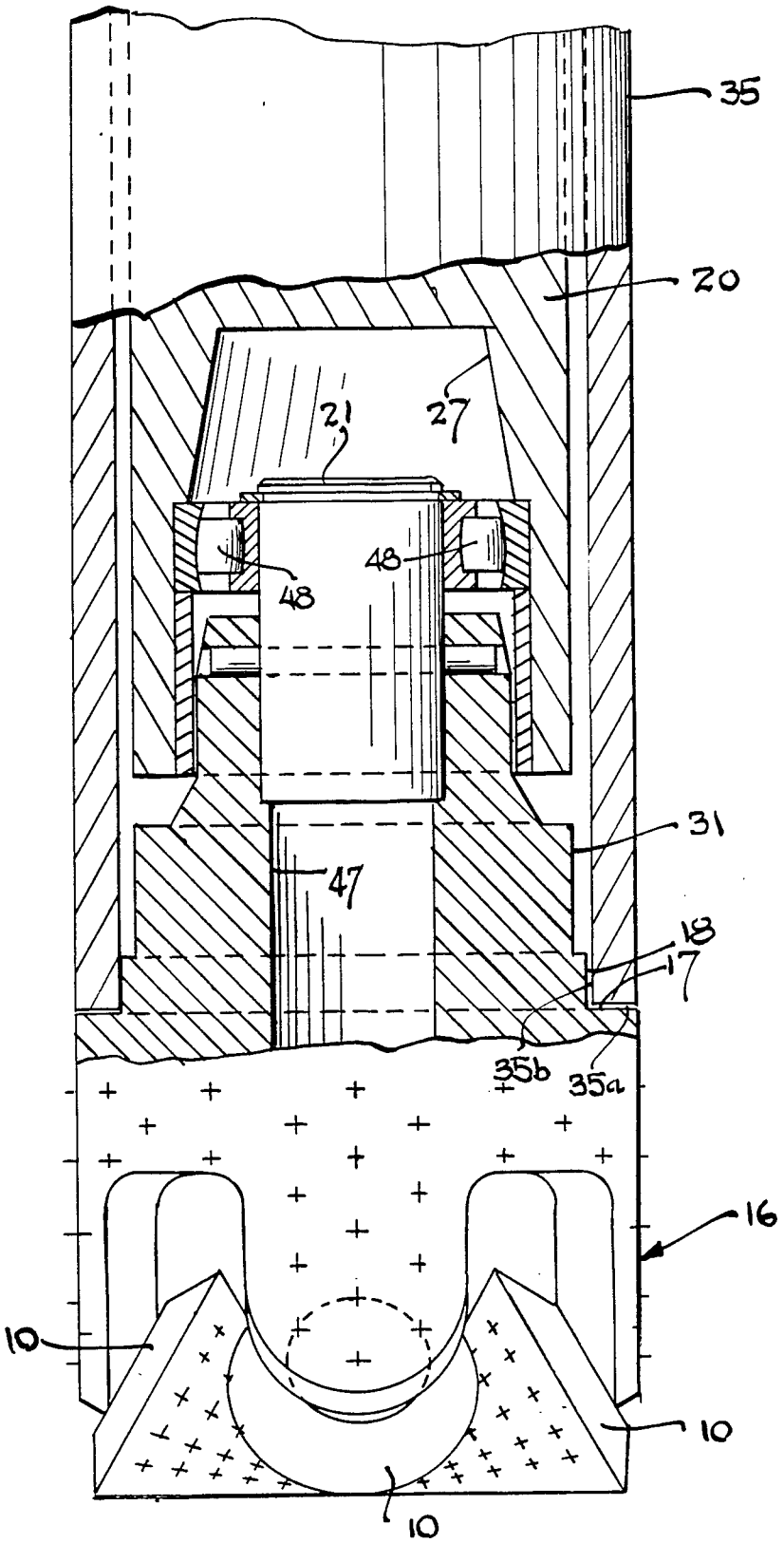
FIG. 2 is an elevational view in cross section illustrating a second embodiment of the invention.

Referring now to FIG. 2, a second embodiment of the invention is illustrated. This embodiment uses structures somewhat akin to that of FIG. 8 of my aforementioned patent application ser. No. 505,954 of which the present application is a continuation in part. As for the first embodiment, cycloidal sonic energy is generated in the drill stem 20 in the same manner as described in application Ser. No. 505,954 or my U.S. Pat. No. 4,271,915. In this embodiment, the drill bit assembly 16 which has roller cone drill bits 10 thereon, has a top extension portion 21 which as for the previous embodiment, is installed in a socket 27 formed in the bottom of drill stem 20. In this instance, however, a spherical roller bearing 48 is employed to rotatably support the drill bit assembly. As for the previous embodiment, an undercut portion 31 is formed in the bit assembly 16 into which the bottom end of drill jacket 35 loosely fits, there being a horizontal shoulder 17 and a vertical shoulder 18 formed in the undnercut portion which respectively interface with the bottom edge 35*a* and the inner wall 35*b* of the jacket. A fulcrum is thus formed for the bit assembly at the interface between shoulder 17 and the bottom edge 35*a* of the jacket in the same manner as for the previous embodiment, lateral motion of the bit assembly being limited by virtue of the interface between shoulder 18 and the inner wall 35*b* of the jacket. Operation of this second embodiment, thus, is similar to that described for the first embodiment, the only difference being the additional lateral limitation of movement imposed by virtue of bearing 48.

Figures 3, 3A:
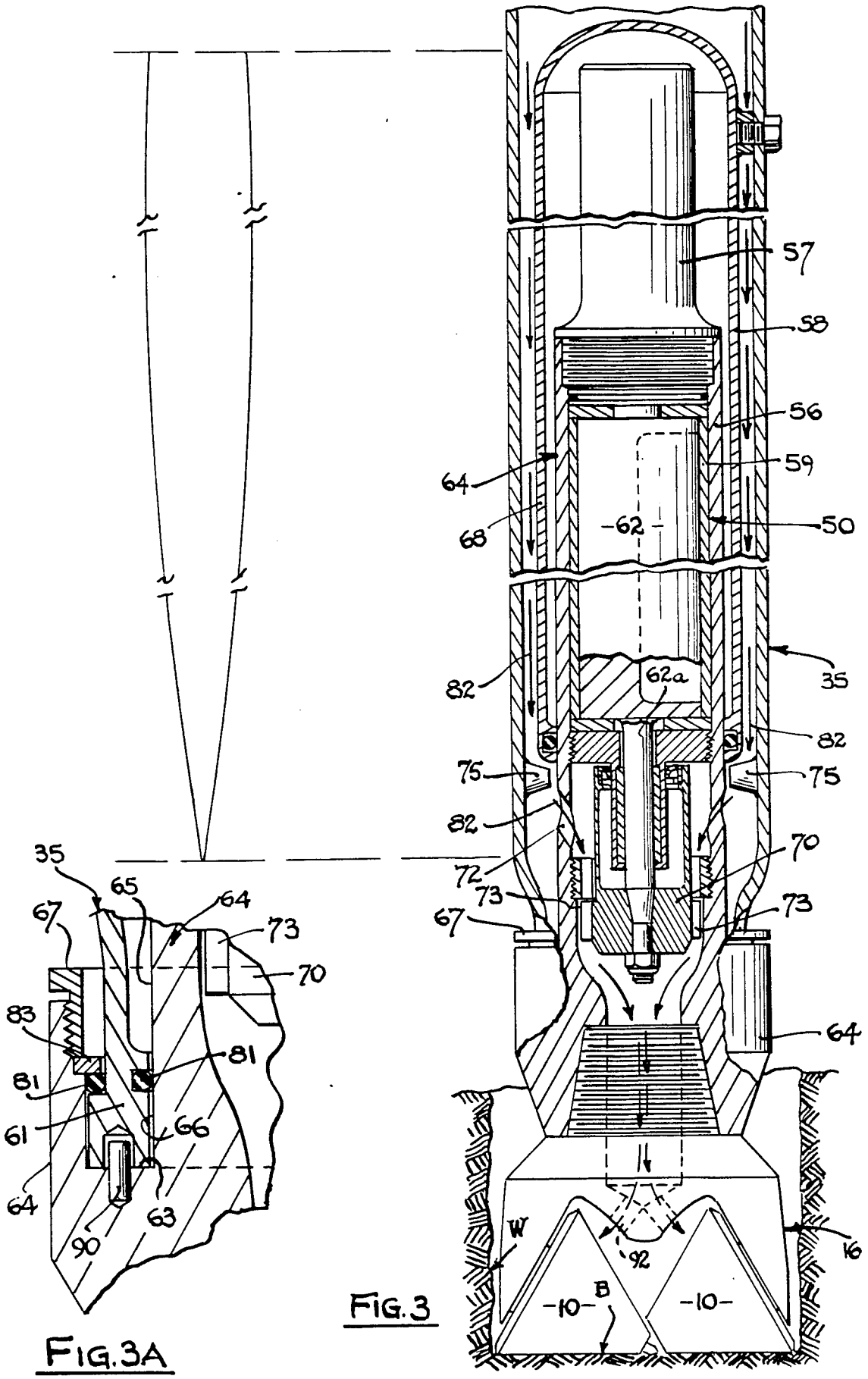
FIG. 3 is an elevational view in cross section illustrating a third embodiment of the invention.
FIG. 3A is a blown up view of a portion of the embodiment of FIG. 3.

Referring now to FIGS. 3 and 3A, a still further embodiment of the invention is illustrated. This embodiment is particularly suited for situations where precise control of drilling direction is required, as under conditions of high sonic power drilling. In this embodiment, the freedom of rocking or tilting of the bit is held to close tolerances so that the attitude or alignment of the bit averages a reliably squared up alignment with the axis of the drill stem. Thus, the bit cannot stray off in direction with the sonic rocking of the bit. This embodiment also incorporates the oscillator in the drill bit assembly to afford higher power drilling action.

Bit assembly 16 is threadably attached to oscillator assembly 50, this oscillator assembly being mounted within drilling jacket 35. Incorporated into the oscillator assembly is a turbine 70 having turbine blades 73 thereon, which are driven by a flow of mud indicated by arrows 82. Oscillator rotor 62, which is in the form of a half shell and is therefore unbalanced, has its drive shaft 62*a* directly connected to the turbine, and thus, is rotatably driven thereby. Cycloidal sonic energy is thus developed in oscillator housing 56. The oscillator is located above the turbine to position it as far as possible from the bit assembly 16, thus, permitting the oscillator to have greater vibratory motion for maximum power generation at the bit, with a longer effective lever arm for this vibratory energy. The stroke of the oscillator may be augmented by the use of an optional resonator bar member 57 threadably attached to the oscillator housing 56, which vibrates with the oscillator housing and effectively forms a resonator to counterbalance the vibration of this housing. A jacket 58 is provided around bar member 57, this jacket being filled with air or other gas to minimize damping of the bar member by drill mud or other extraneous material within the drill jacket 35. The elastic bar member 57 may be dispensed with in situations where sufficient energy can be generated by the oscillator and is only needed where additional driving power is called for.

The mud flow, as indicated by arrows 82, passes through the drill string jacket and the oscillator assembly 50, by way of ports 72 and the turbine blades 73, finally being exited into the bottom of the bore hole through jets 92 formed in drill bit assembly 16. As best can be seen in FIG. 3A, the jacket 35 is joined to the oscillator-turbine assembly 64 by means of a flange 61 formed at the end thereof, which rests on a mating shoulder 63 formed in a grooved portion 65 of the oscillator-turbine assembly, thereby embracing flange 61. "O"-rings 81 seal off the lower portion of the flange so that the area can be filled with lubricant and sealed off from outside debris and mud. A hold down ring 67 is employed in conjunction with a retainer washer 83 to clamp down the "O"-rings, this hold down ring being threadably attached to the oscillator-turbine assembly 64. Thus, a horizontal shoulder 63 is provided in the oscillator-turbine assembly while a vertical shoulder 66 is provided to limit lateral movement of the bit assembly in the same manner as in the previous embodiments.

In operation, the down flowing mud stream indicated by arrows 82, which is conventionally supplied down the drill string for washing the cuttings out of the bore hole, rotatably drives the turbine blades 73 typically at a speed of the order of 100 rps thereby likewise driving the oscillator rotor. This causes the oscillator housing to precess in a relatively small orbit and causes a cycloidal vibratory motion of the oscillator housing in orbiting fashion. This results in a cycloidal nutational action of the drill bit against the walls of the bore hole. Although the oscillator housing orbits with appreciable amplitude, the gap at shoulder 63 is relatively small due to the weight of the drill string and the hydrostatic mud pressure acting on "O"-rings 81. Nevertheless, it is to be noted that in view of the fact that the drill jacket 35 and the housing of the oscillator-turbine assembly are not rigidly fastened together, there is some freedom of motion between these two elements to permit the desired nutational motion of the drill bit about the fulcrum formed at shoulder 63. Bumper members 74 are welded to jacket 35 to further limit the tipping motion of the oscillator-turbine assembly. It is to be noted that the drill bit can be rotated conventionally from the surface by virtue of dowels 90 which couple the drill jacket to the drill for transmission of torque therebetween. It is also to be noted that in drilling particularly hard rock formations, only a relatively small freedom of rocking movement is needed to achieve the desired nutational motion of the drill bit.

Figure 4:
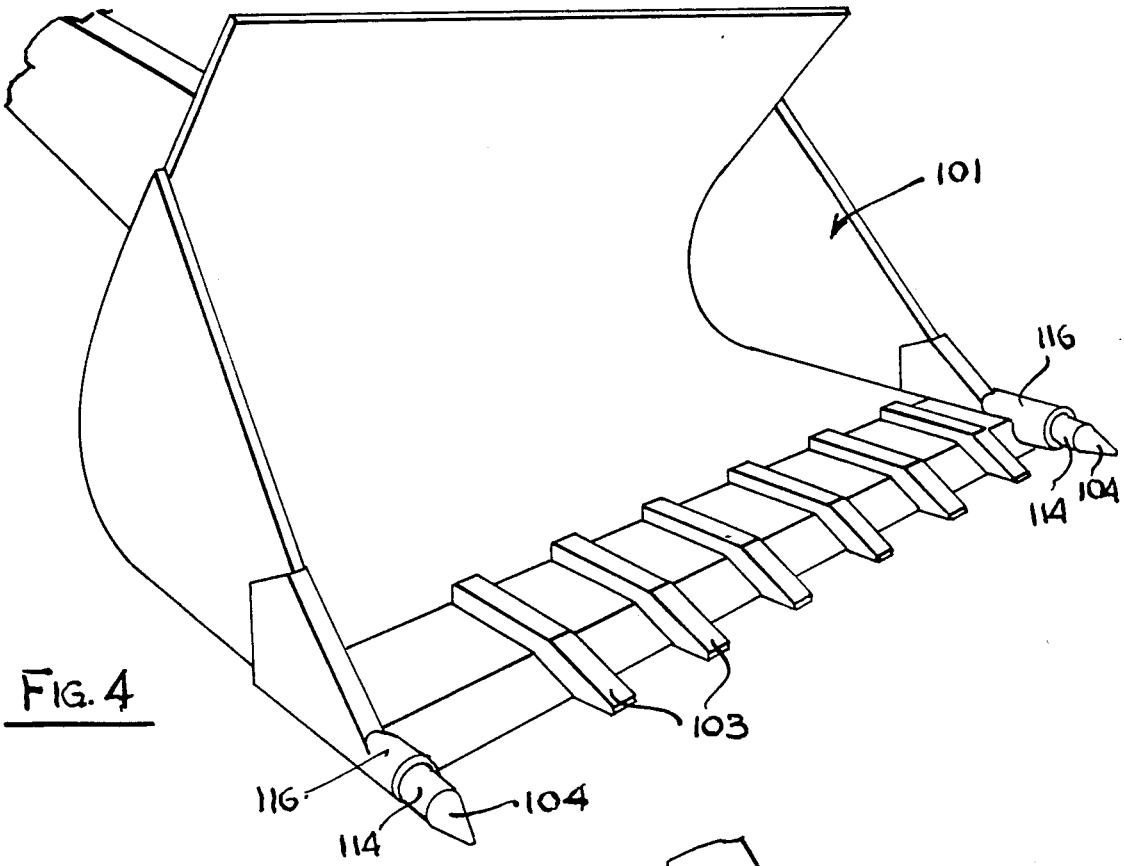
FIG. 4 is a perspective drawing illustrating a fourth embodiment of the invention incorporated.
Figure 5:
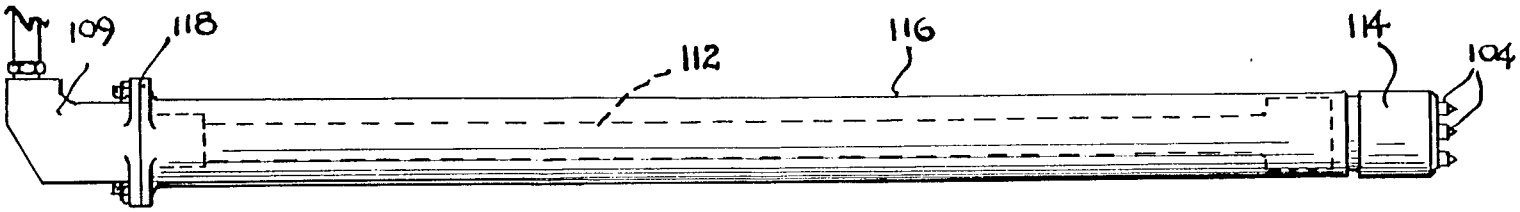
FIG. 5 is a side elevational view of an alternative embodiment form of the bit structure for the fourth embodiment.
Figure 6:
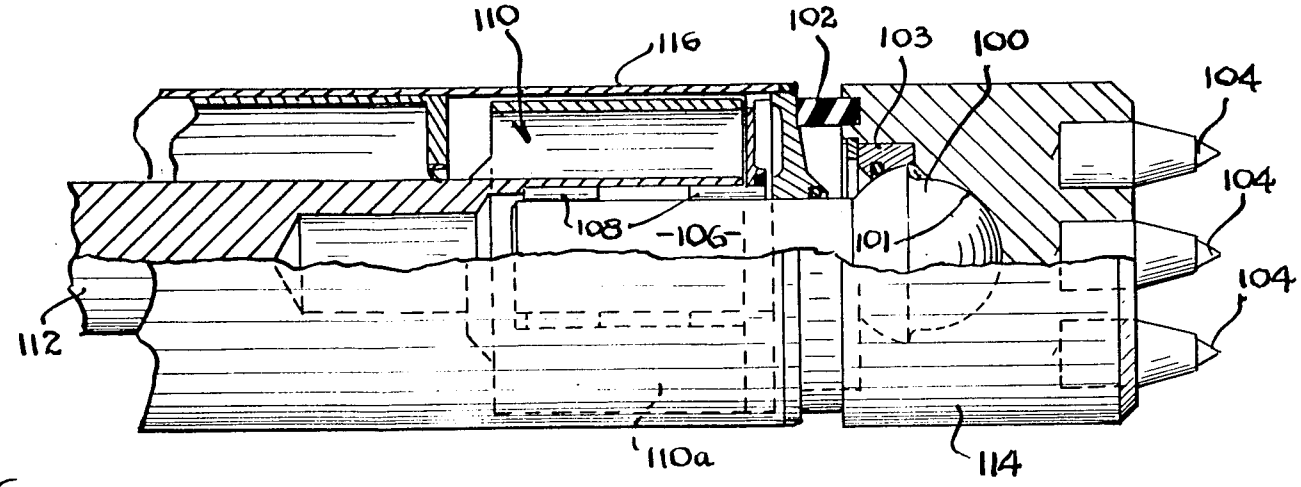
FIG. 6 is a blown up view, partially in cross section of a drive mechanism which may be employed in the fourth embodiment.

Referring now to FIGS. 4–6, a further embodiment of the invention is illustrated. This embodiment is particularly adapted for use as a rock splitter in earth moving operations and may be incorporated into a rock stripping wheeled loader.

Figure 4A:
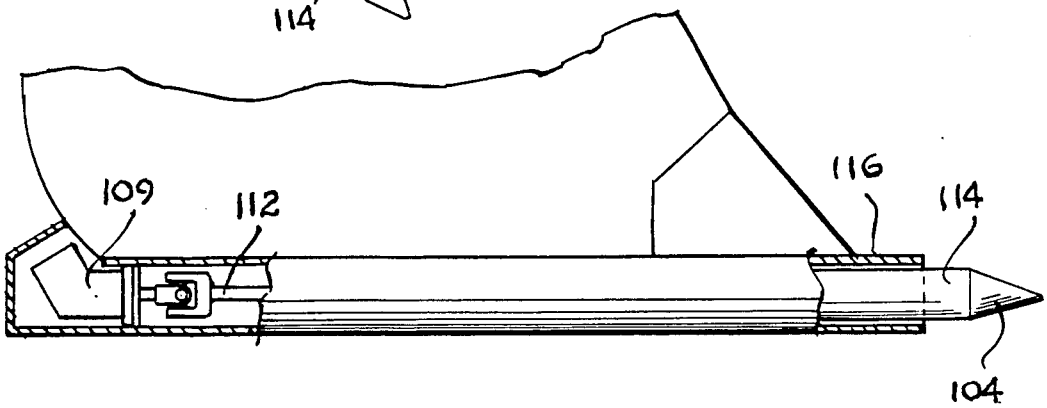
FIG. 4A is a side elevational view of a sonic cutter of the fourth embodiment.

Referring first to FIGS. 4 and 4A, the device of the invention is shown incorporated into the bucket 101 of a rock stripping wheel loader (not shown). The normal cutter teeth 103 are incorporated into the central portion of the bucket. At the opposite ends of the bucket a pair of carbide teeth 104 are provided, these teeth each being supported in an associated bit body 114 which, in turn, is mounted in a cylindrical housing 116. Cylindrical housings 116, in turn, are mounted along the cutter edge such as at opposite ends of the bucket. As shown in FIG. 4A, a hydraulic motor 109 is provided for each of the assemblies, these motors each driving an orbiting mass oscillator (not shown) through drive shaft 112. The oscillator and the coupling between the oscillator and the bit body 114 may be the same as that shown in FIG. 6 so as to effect nutating motion of teeth 104.

Referring now to FIGS. 5 and 6, an alternative configuration of the embodiment of FIGS. 4 and 4A is shown. This embodiment is basically the same as that of the prior embodiment except for the incorporation of a plurality of bits 104 typically in a linear row across the end of each bit body. Cyclindrical housing 116 has a hydraulic motor 109 mounted on one end thereof by means of flange 118 and a bit body 114 supported on the opposite end thereof, bit body 114 having a plurality of cutting teeth 104 typically installed therein along a linear row as shown, these teeth being made of a hard material such as carbide. Drive shaft 112 is rotatably driven by motor 109 and in turn rotatably drives eccentrically weighted rotor 110*a* of orbiting mass oscillator 110. Rotor 110*a* is mounted for rotation about stem member 106 on needle bearings 108. Ball member 100 is integral with stem 106 and forms a ball and socket joint 101 with a concave portion of bit body 114 in which the ball member is seated. A fulcrum for rocking motion of bit body 114 is formed by said ball joint working with elastomeric centering spring 102 which is cylindrical in form and which joins together housing 116 and bit body 114. Elastomeric member 102 not only acts as a centering spring, but also functions as a seal to prevent foreign matter from entering the ball and socket joint.

In operation, drive shaft 112 rotatably drives oscillator rotor 110*a* to generate cycloidal sonic energy. This cycloidal energy is transferred to stem member 106 and through the ball and socket joint to bit body 114 to effect rocking motion of the row of teeth 104. Rocking motion of the bit body 114 on its ball and socket joint 101 is effected on the fulcrum provided by elastromeric spring 102. The nutating cycloidal energy greatly enhances the cutting action of the bits by virtue of the fatigue that it induces in the rock formation.

In view of the highly effective operation of the sonic nutational action achieved in the present invention, it is often not necessary to employ strong resonant operation of the system. Thus, the present invention is particularly useful in drilling deep wells where the mud pressure is great and the vibration of a resonant column might be dampened significantly.

While the invention has been described and illustrated in detail, it is to be clearly understood that this is intended by way of illustration and example only and it is not to be taken by way of limitation, the spirit and scope of this invention being limited only by the terms of the following claims:

I claim:

1. In a sonic drilling system for drilling a bore hole including an oscillator for generating sonic energy in a cycloidal mode of vibration said oscillator having a housing which is driven by said sonic energy, and a bit assembly coupled thereto, the improvement being rocker type coupling means for guiding the housing and the bit assembly to form a pivotal fulcrum which permits limited motion of the bit assembly both vertically and laterally in a nutating pattern, comprising:

a horizontal shoulder formed on the top portion of the bit assembly;

a vertical shoulder formed on the top portion of the bit assembly;

vertical motion limiting means positioned directly opposite the horizontal shoulder for permitting limited freedom of vertical motion of the bit assembly relative to the housing; and lateral motion limiting means positioned directly opposite the vertical shoulder for permitting limited freedom of lateral motion of the bit assembly relative to the housing;

said rocker type coupling means forming the fulcrum of a lever arm for the bit assembly so as to enable the bit assembly to nutate in a rocking fashion against the bore hole in response to the sonic driving.

2. The drilling system of claim 1 and further including an elastic bar member connected to the oscillator housing and sonically driven thereby and wherein the rocker type coupling comprises a bit assembly extension which extends upwardly therefrom, a socket being formed in the bottom of said bar member into which the bit assembly extension is matingly fitted, and means for retaining the extension in the socket with limited universal freedom of motion therebetween.

3. The drilling system of claim 2 wherein a clearance is provided in the socket between the extension and the bar member, said clearance forming a rectifier gap for converting said sonic energy into unidirectional pulses.

4. The drilling system of claim 2 wherein the means for retaining the extension in the socket comprises an annular groove formed in the extension and a retainer pin extending from the bar member into the groove.

5. The drilling system of claim 2 wherein the means for retaining the extension in the socket comprises a roller bearing for supporting the extension in the socket.

6. The drilling system of claim 2 wherein the vertical and lateral motion limiting means comprises a cylindrical jacket surrounding said bar member in external concentricity therewith.

7. A drilling system for drilling a bore hole in the ground comprising:

a bit assembly;

an orbiting mass oscillator assembly fixedly attached to said bit assembly and in direct contact therewith, said oscillator assembly having an annular groove formed therein, said grove having vertical and horizontal shoulders;

means for driving said oscillator assembly to develop cycloidal sonic energy in said assembly;

a drilling string jacket member surrounding the oscillator assembly in concentricity, therewith, there being limited universal freedom of motion between the oscillator assembly and the jacket member, said jacket member having an end flange portion fitted into the groove of said oscillator assembly in opposing relationship to the horizontal and vertical shoulders of the groove;

the cycloidal sonic energy generated in the oscillator assembly causing the bit assembly to nutate against the walls of the bore hole with a fulcrum for such nutation being formed at the horizontal shoulder of said groove.

8. The system of claim 7 wherein the means for driving the oscillator assembly comprises a turbine incorporated into said assembly and an unbalanced oscillator rotor coupled to the turbine, a mud stream being directed through said turbine to effect the rotation thereof.

9. The system of claim 7 and further including a resonator bar member attached to the oscillator assembly to form a resonator to counter balance the vibration thereof.

10. The system of claim 9 and further including a gas filled jacket surrounding the resonator bar member to protect against damping of said bar member by extraneous material.

11. In a sonic system for splitting rock, including an oscillator for generating sonic energy in a cycloidal mode of vibration, and a bit assembly, the improvement being rocker type coupling means for coupling sonic energy from the oscillator to the bit assembly, said coupling means forming a pivotal fulcrum which permits limited motion to the bit assembly, both vertically and laterally in a nutating pattern comprising;

a housing for containing the oscillator, said oscillator having an eccentrically weighted rotor member;

ball-socket joinder means for supporting the bit assembly on said housing for limited vertical and lateral motion relative to the housing; and spring means interconnecting the housing and the bit assembly for resiliently urging the bit assembly into alignment with the housing, said spring means forming the fulcrum limitation of a lever arm for the bit assembly so as to enable the bit assembly to nutate in a limited rocking fashion in response to the sonic driving.

12. The system of claim 11 wherein the spring means comprises an annular elastomeric member interconnecting the housing and the bit assembly.

* * * * *